United States Patent [19]

Manusch et al.

[11] Patent Number: 5,006,184

[45] Date of Patent: Apr. 9, 1991

[54] HAND OPERATED DEVICE FOR TRANSFERRING A FILM FROM A CARRIER TAPE TO A SUBSTRATE

[75] Inventors: Cristoph Manusch, Hemmingen; Hans-Jürgen Harp, Hannover, both of Fed. Rep. of Germany

[73] Assignee: Pelikan Aktiengesellschaft, Hanover, Fed. Rep. of Germany

[21] Appl. No.: 431,610

[22] Filed: Nov. 3, 1989

[30] Foreign Application Priority Data

Nov. 5, 1988 [DE] Fed. Rep. of Germany ..... 3837621

[51] Int. Cl.[5] ..... B32B 31/00

[52] U.S. Cl. ..... 156/577; 156/579; 156/584; 242/193; 242/194

[58] Field of Search ..... 156/577, 579, 584, 523, 156/527; 242/55.3, 129.1, 129.3, 128, 193, 55.19 R, 67.5, 58, 194

[56] References Cited

U.S. PATENT DOCUMENTS

| | | | |
|---|---|---|---|
| 3,314,625 | 4/1967 | Mahn | 242/193 |
| 3,398,909 | 8/1968 | Jotzoff | 242/193 |
| 3,552,686 | 1/1971 | Davidson | 242/193 |
| 4,015,292 | 3/1977 | Kirn | 242/194 X |
| 4,324,603 | 4/1982 | Crandall et al. | 156/527 X |
| 4,853,074 | 8/1989 | Manusch et al. | 156/577 |

*Primary Examiner*—David A. Simmons
*Assistant Examiner*—J. Sells
*Attorney, Agent, or Firm*—Herbert Dubno

[57] ABSTRACT

In a hand operated device for transferring a film (28) from a carrier tape (22) to a substrate, in which in a casing the carrier tape (22) is guided from a smaller supply reel (3) to a pressure edge (33) of an application foot (31) projecting outwards at the bottom on the casing and from the foot back into the casing and onto a larger take-up reel (4), in that the supply and take-up reels (3,4) are coupled together by means of a slip clutch acting in the rotation direction and to the casing are fitted guide means for guiding the carrier tape (22), the supply reel (3) and take-up reel (4) being axially juxtaposed and inclined at an acute angle to one another. At the bottom, the smaller supply reel (3) projects into the inner area (24) of the larger take-up reel (4) on the side thereof open towards reel (3), while its top surface is located completely outside the same. The slip clutch is located centrally between the two reels (3,4). The guide means in the guide of the carrier tape (22) are positioned between supply reel (3) and application foot (31). The pressure edge (33) of the application ledge (32) fitted to the end of the application foot (31) is followed by a guding edge (34) inclined at an angle thereto for the lateral deflection of the carrier tape (22) towards the take-up reel (4).

16 Claims, 4 Drawing Sheets

Figure 1:
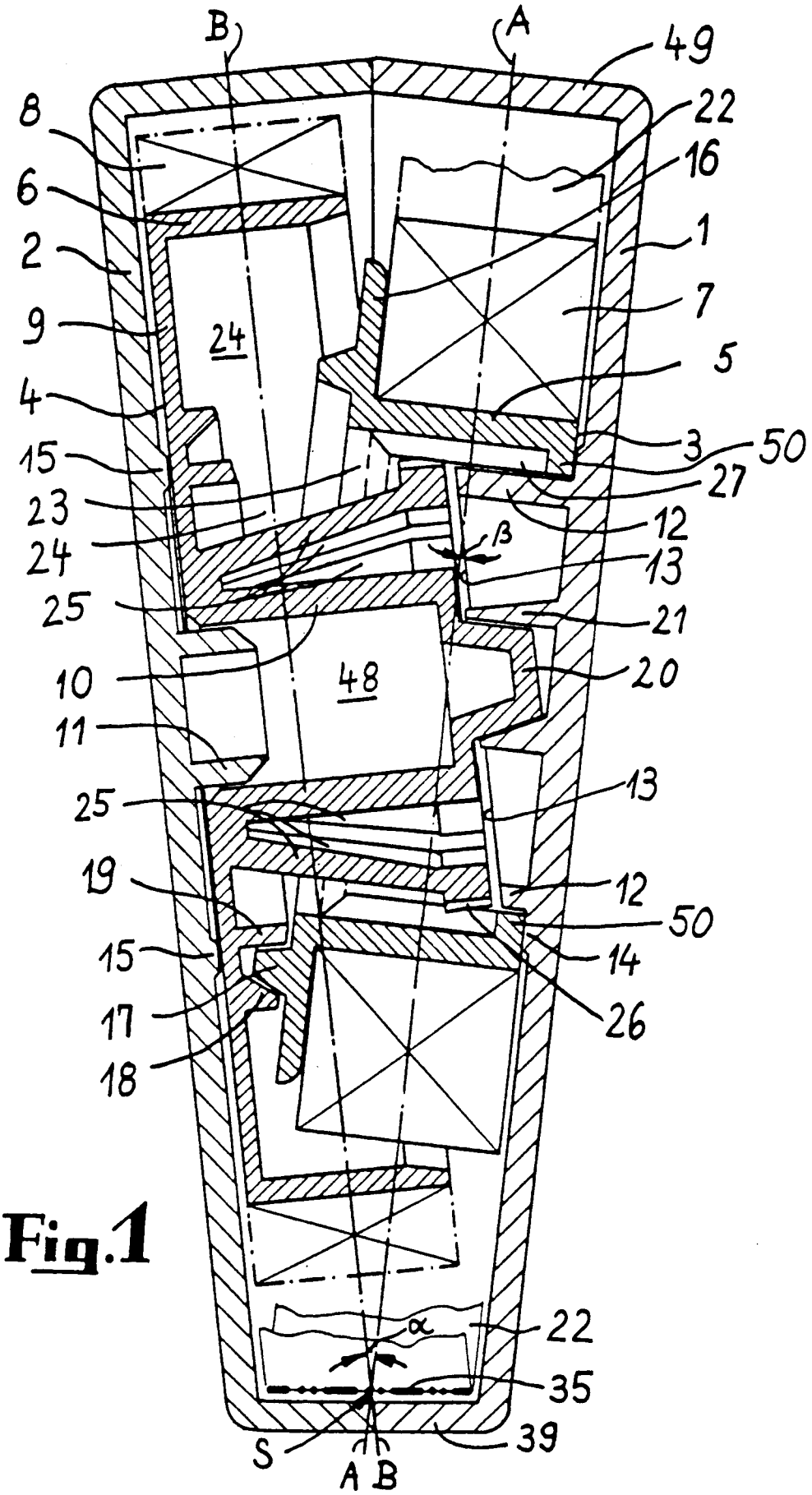

Fig.2
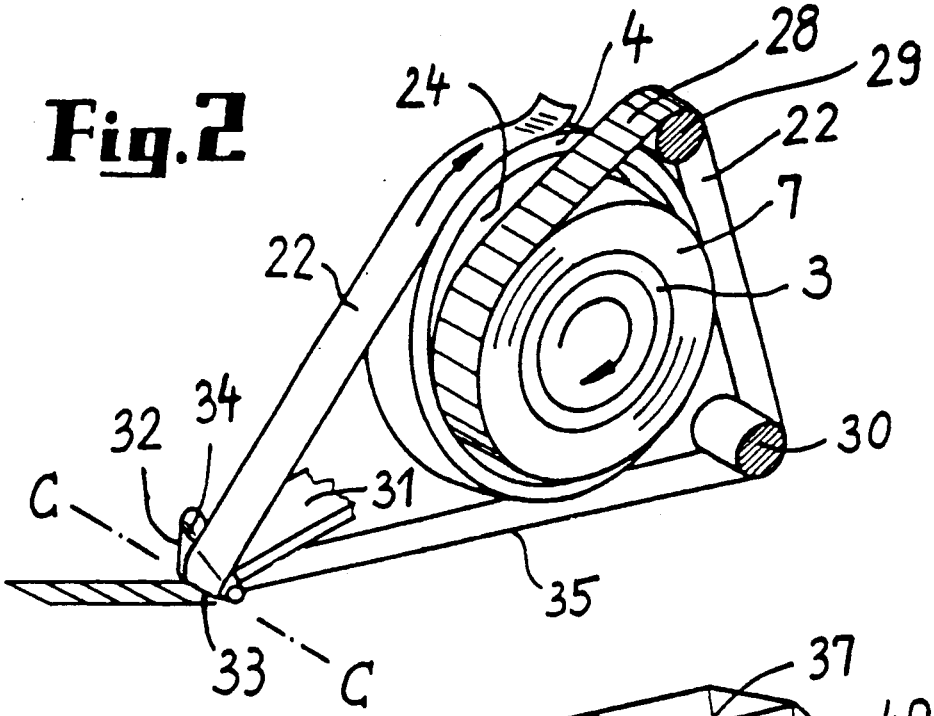
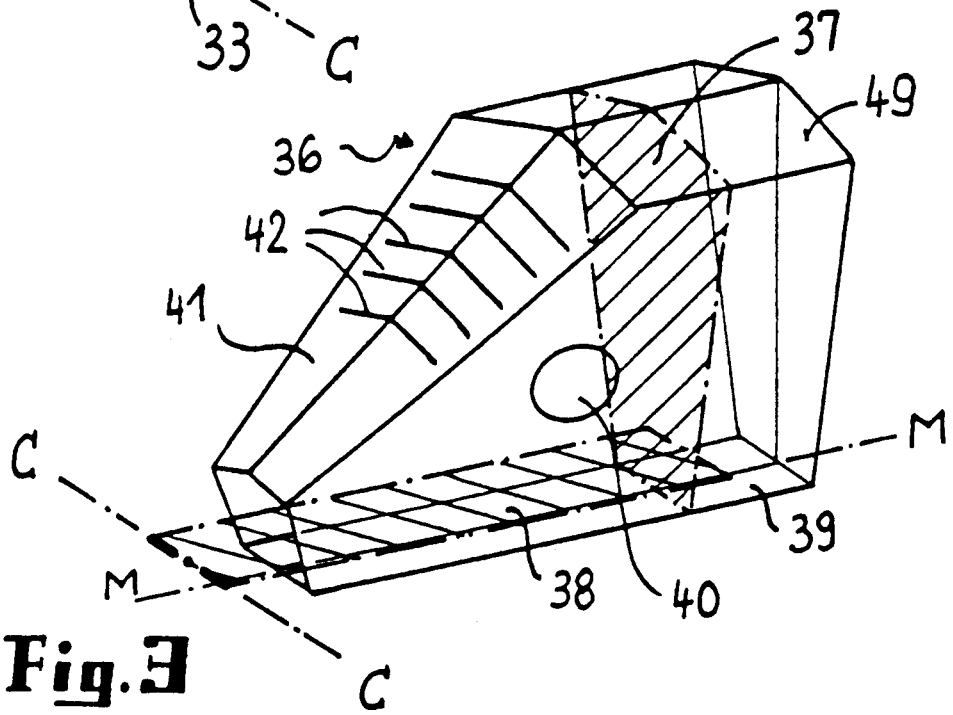
Fig.3

HAND OPERATED DEVICE FOR TRANSFERRING A FILM FROM A CARRIER TAPE TO A SUBSTRATE

The invention relates to a hand operated device for transferring a film from a carrier tape to a substrate, in which in a casing the carrier tape is led from a supply reel to a pressure or contact edge of an application foot or base projecting outwards at the bottom of the casing and from there back into the latter onto a larger take-up reel, the supply and take-up reels being coupled together by means of a slip or safety clutch acting in the rotation direction, and with guide means fitted to the casing for guiding the carrier tape.

Known hand operated devices for transferring an adhesive film applied to a carrier tape or a double-sided adhesive tape received there to a substrate, e.g. to a paper surface for sticking to another paper, etc. have an arrangement of a supply reel and a take-up reel in one plane. The slip clutch, which must be provided between the two rotary receptacles for the reels, is driven by means of two meshing gear wheels connected to the pivot pins for mounting the reels and which are fitted in a second plane located alongside the reels. The consequence of this is that the tape guide and therefore also the pressing region of the carrier tape at the end of the application element is not central with respect to the casing width when a minimum overall casing width is to be obtained, so that it is not equally advantageously possible for the device to be used by left and right-handed people. However, if a central tape guidance with respect to the casing width is to be achieved, on the side of the two reels facing the gear wheels it is necessary to provide an unnecessarily large spacing from the casing sidewall located there. As a result the device is particularly unwieldy and there is an unavoidable extra material expenditure. Fundamentally the casing for such devices is always relatively large, because it must be able to receive reels juxtaposed in one plane filled with a maximum tape supply, which per se leads to a certain unwieldiness of the device, which can in particular cause handling problems when used by children or unskilled people. Due to the relatively large device casing length, it is not possible to e.g. carry it in the pocket of an article of clothing, because it is too large and bulky for this purpose.

In a known device described in German Patent 37 18 065, the application element is constructed in the form of a holding foot or base projecting in sloping manner out of the casing and which is provided at its free end with a rotary guide pulley for the carrier tape. The rotation axis of the guide pulley is between the rotation axes of the two reels, so that there is a relatively short carrier tape length between the tape discharge point from the supply reel and its entry point onto the take-up reel. This obviates the need for using additional guide means for guiding the tape and the frictional forces acting on the carrier tape along its guide are relatively small. However, the overall arrangement of the pressing or contact foot means that on the underside of the casing it passes out in a central region thereof, so that the pressing zone of the guide pulley by which the carrier tape is pressed against the substrate when the device is in use, is still clearly remote from the front end of the device casing. This leads to an unfavourable position of the pressing point with respect to the substrate, which in particular makes it difficult to handle the device when during use it cannot be seen from the side (i.e. if the user moves the device towards him).

Also in the case of another hand operated device known from DE-OS 36 38 722, the reels are juxtaposed in one plane, the position of the reels and the external configuration of the overall casing being chosen in such a way that the application foot with the pressure edge projects forwards at the front end of the casing tapering at this point. In the case of said device the pressure edge and application foot are not arranged in the centre of the casing, so that although the width of the latter is minimized, the handling is much more difficult for left-handed than for right-handed persons. In addition, for guiding the carrier tape, considered in the transportation direction thereof, guide means for said tape are connected downstream of the pressure edge of the application foot and bring about a deflection of the tape running into the casing towards the take-up reel, so that a casing construction tapering towards the front of the device and which is favourable for handling is obtained. The slip clutch is driven by means of a toothed gear fitted alongside the common reel plane, the drive (as in the first-mentioned device) taking place from the supply reel. The frictional forces occurring on the guide means between the pressure edge and the take-up reel and additionally acting on the carrier tape must be absorbed by means of the toothed gear and the slip clutch, which means that these parts must have larger dimensions. Although this device can be used in the most appropriate manner by the user as a result of its shape, due to the driving forces to be additionally transferred by the toothed gear and the slip clutch as a result of friction on the guide means this is less favourable for the design of the gear and leads to a large casing construction, which makes it difficult for the device to be used, e.g. by children and still does not permit easy conveying, e.g. in the pocket of an article of clothing.

On the basis of this, the problem of the present invention is to so further develop a hand operated device of the aforementioned type that handling is further improved and in particular a much smaller and more compact construction of the casing is obtained, with significantly reduced constructional costs.

According to the invention this is achieved in that in the case of a hand operated device of the aforementioned type the supply reel and the take-up reel are axially juxtaposed and set at an acute angle to one another, the smaller supply reel (with the tape supply carried by it) projecting at the bottom into the interior of the reel core of the larger take-up reel open on the side facing it, whilst its top is completely outside the said interior of the reel core of the take-up reel, that the slip clutch is positioned centrally between the two reels, that the guide means are fitted in the carrier tape guide between the discharge point of the carrier tape from the supply reel and the application foot and that the pressure edge is followed by a guide edge inclined at an angle thereto and which is used for laterally guiding the carrier tape from the pressure edge towards the larger take-up reel.

As a result of the axially juxtaposed reels in the case of the inventive device, it is ensured that the casing length does not have to be such as to receive two successive reels in the same plane, which results in a significant shortening thereof. As a result of the V-shaped setting of the two reel planes with respect to one another, the projection of the smaller reel at the bottom into the interior of the larger reel core, as well as the arrangement of the slip clutch in the central region of the two reels and between the same means that the casing width caused by the juxtaposing of the two reels is reduced to a practical minimum, so that there is a maximum space utilization in the casing and a minimum overall volume surrounded by the casing. In addition, the possibility is given for the casing sidewalls to diverge upwards in V-shaped manner from the lower casing bottom, so that the casing receives a width which increases from bottom to top. This leads to a wedge-shape, downwardly tapering casing shape, which is particularly advantageous for use. Thus, at the top where the pressure is exerted by the fingers of the user (because the casing is loaded by the user from top to bottom towards the application element), the maximum casing width and therefore a large bearing face for the pressing fingers are provided. The wedge shape ensures a particularly good holding in the hand, because the casing on the downwardly wedge-shaped tapering sidewalls can be braced towards the upper pressure surface formed by the hand. In addition, the two sidewalls (and therefore the lateral gripping surfaces) diverge upwards counter to the slipping direction for the fingers, which also contributes to a reliable good holding of the device casing in the user's hand. As a result of the V-shaped tapering of the reel planes and the arrangement of the slip clutch between the same, the possibility is given of arranging the application foot fitted to the front casing end centrally with respect to the casing bottom, which leads to the avoidance of a one-sided displaced exit of tape from the casing and an accurate application of the tape to the substrate for both left and right-handed people. Compared with known devices, the inventive device has a much shorter and compact construction which, in conjunction with the possibility of a wedge-shaped casing construction and a central tape guidance when the tape is discharged, leads to an improvement to handling. As now there is only a slip clutch and not a gear between the two reels, the number of components used is also smaller than in known devices, which reduces material costs for the overall casing. Due to the omission of a lateral gear, the top surface of the inventive device is scarcely wider than known devices, in which, apart from the reel width, axially and laterally additional space must be provided for receiving the gear. Due to the fact that in the case of the inventive device the take-up reel has from the outset a relatively large diameter, so that the supply reel with its full tape supply can project into the interior of the take-up reel core, there is an increase in the external diameter of the take-up reel of only comparatively small magnitude, even when the entire tape length is wound on. As the force proportions when using the device are particularly influenced by two factors, namely the diameter reduction of the supply reel (dispensing reel) and the diameter increase of the take-up reel, this means that in the case of the inventive device the force proportions are modified less markedly over the entire tape length than in known devices, in which there are relatively equally large, significant diameter increases and decreases on the two reels. This also improves the handling of the inventive device. In the case of the inventive device, the empty diameter of the take-up reel is always larger than the maximum diameter of the supply reel, measured with a full tape supply, so that the unwinding speed of the supply reel is always larger than the winding speed of the take-up reel. Thus, with respect to the drive conditions it is always possible to ensure a positive slip of the take-off reel relative to the take-up reel and consequently the necessary tape tension is always ensured, which makes it completely unnecessary to use a transmission gear, because under no operating conditions is it necessary to incorporate an acceleration by means of a gear. In the case of the inventive device, the wedge shape of the casing also enables the device to stand, only limited space being required at the application surface (much as for adhesive bottles). The special arrangement of the two reels ensures that the carrier tape on the dispensing reel can always be drawn off at the top in a free and unhindered manner, because the supply reel there is completely positioned outside the interior of the take-up reel core.

As in the case of the hand operated device according to the invention the carrier tape is wound directly onto the take-up reel behind the pressure ledge and all the deflections necessary for the tape guidance only exist between the supply reel and the pressure ledge, during use the tape deflection forces are directly applied by the user and unlike in the case of a deflection behind the application point, no longer have to be absorbed by the slip clutch, which is advantageous for the dimensioning thereof.

Preferably, in the case of the inventive device, the setting angle between the two reel planes is between min 10° and max 15° and is advantageously 12°. The carrier tape, which must be twisted from the supply reel to the pressure edge and from the latter to the take-up reel in each case by half the setting angle between the two reel planes, can, on selecting the setting angle within the aforementioned angular range, be guided in completely problem-free manner with the then necessary twist between 5° and 7.5° (in each case between the pressure edge and one of the two reels). These setting angles are adequate for appropriate reel diameters in order to permit an unhindered carrier tape removal at the top when the supply reel is full and simultaneously the tape only has to be twisted relatively slightly between the reels and the pressure edge, so that this angular range leads to an optimization of the external shape of the casing, with respect to the need for limited width and simultaneously adequate height for an unhindered drawing off of the carrier tape from the supply reel.

In a particularly preferred manner in the case of the inventive device, the application foot is constructed in such a way that its pressure edge is in a plane, which is at right angles to the angle bisector of the spreading angle between the two reels and passes through the common sectional line of the two reel median planes. This plane constitutes the sectional plane obtained if the winding regions of the two reels are extended to the reciprocal intersection point at their portions converging at the bottom. Thus, this "common" sectional plane precisely constitutes the median plane from which the two reels have an identical angular setting with respect to the tape, in the case of an identical divergence and without a one-sided displaced tape exit.

According to another advantageous development of the invention the slip clutch is constructed with a force closure acting within the reel core of the smaller supply reel.

In a particularly preferred manner the take-up reel is provided with a one-sided hollow, central stay bolt projecting from the interior of its reel core into that of the reel core of the supply reel and with whose projecting end it is mounted in a bearing recess of the sidewall on the side of the supply reel and at its other end with its inner bore open there on a trunnion on the other casing sidewall. Thus, in simple manner, a double axial supporting of the take-up reel on both casing sidewalls is obtained.

Preferably, around said stay bolt are distributed a plurality of radially elastically springing in coupling tongues projecting towards the supply reel and spreading there and provided at their ends with radially outwardly projecting coupling teeth, which at least partly engage in a corresponding inner tooth system fitted to the supply reel core. This leads to a simply constructed slip clutch, which is very effective in the rotation direction, between the two reels in the central region thereof, which ensures a problem-free compensation of the difference in the setting angle of the reels over the entire rotation range and whilst always giving a good slip clutch effect.

According to another preferred development of the inventive device the supply reel is provided on its side facing the take-up reel and at least in its area located radially outside the reel core with a flanged coupling pulley on whose outer face facing the take-up reel is provided a circularly directed support projection which, in the lower area, in which the supply reel enters the interior of the take-up reel core engages against a shape-corresponding circular support in the interior of the take-up reel core on its radial support disk, so that apart from the supporting of the supply reel on the casing sidewall carrying it, it is also supported on the facing casing sidewall.

According to the invention, particularly preferred guide means are constituted by at least two guide pins, which are preferably rotatable, so as to allow a particularly easy tape removal movement. The central axes of the guide pins are preferably arranged parallel to the central axis of the supply reel.

An advantageous further development of the inventive hand operated device involves the leading or guide edge being constructed in one piece on the application foot and preferably at the end of the latter is provided an application ledge in the form of an oblique-angled truncated cone for the formation of the pressure edge and guiding edge.

Another preferred construction of the inventive device is obtained if the guiding edge is arranged on an independent component following the application foot and which preferably comprises a cylindrical guide pin. This leads in simple manner through merely a corresponding alignment of the cylindrical guide pin to the guiding edge being able to laterally deflect the tape guide of the carrier tape freed from the film in the direction of the take-up reel without using a pressure element having a complicated shape.

Preferably the casing sidewall adjacent to each reel is at right angles to the central axis of the particular reel, i.e. is parallel to the reel plane, so that it leads to a minimum cross-sectional surface at right angles to the median longitudinal plane of the device casing.

Due to its compact shape, the inventive device can be particularly advantageously constructed as a disposable device.

According to a preferred construction all parts necessary for its operation, namely the supply and take-up reels, all the tape guidance means and the slip clutch are received in a replaceable cassette, which also carries the application foot, the pressure ledge, the pressure edge and the guiding edge, so that when the tape supply has been used up it is merely necessary to open the casing, remove the cassette therein and insert a new cassette to restore the initial operating state.

The invention is described in greater detail hereinafter relative to non-limitative embodiments and the attached drawings, wherein show:

FIG. 1 a larger scale cross-section through an inventive hand operated device, the rotation axes of both reels being in the sectional plane.

FIG. 2 a basic representation of the arrangement of the reels and the tape guide, as well as the pressure element in an inventive hand operated device.

FIG. 3 a basic illustration concerning the external dimensions for a particularly appropriate shape of a casing for an inventive hand operated device.

FIGS. 4, 5, 6 and 7 fundamental representation of different embodiments for the construction and arrangement of the pressure edge and guiding edge.

Figure 8:
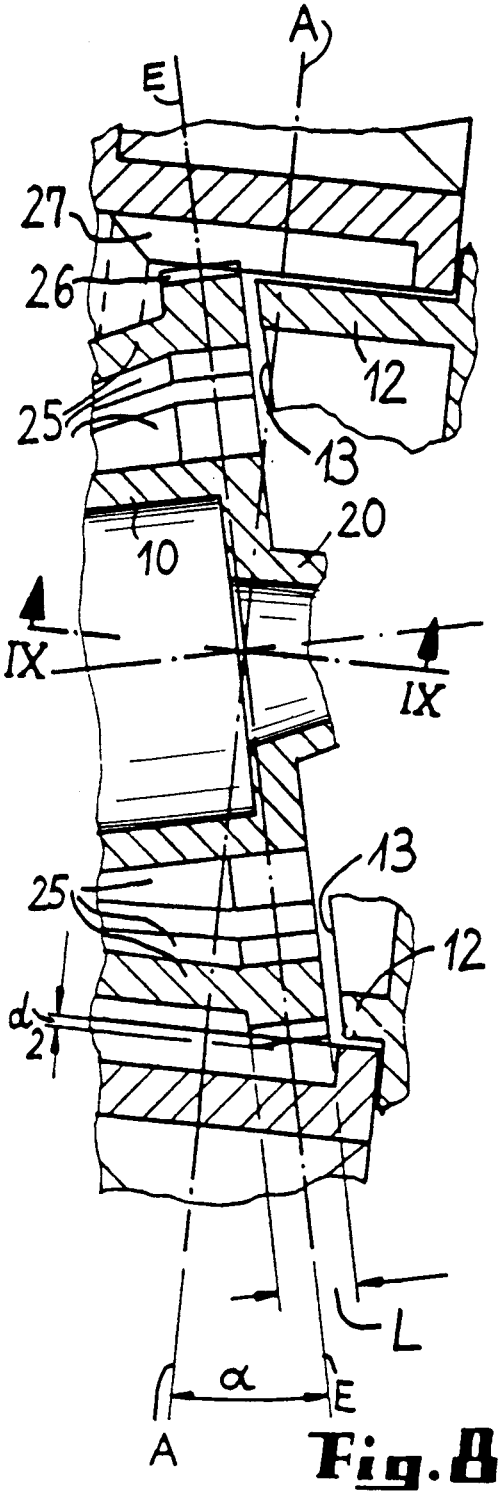

FIG. 8 a larger scale detail of the coupling area within the reel core of the supply reel (detail of FIG. 1).

Figure 9:
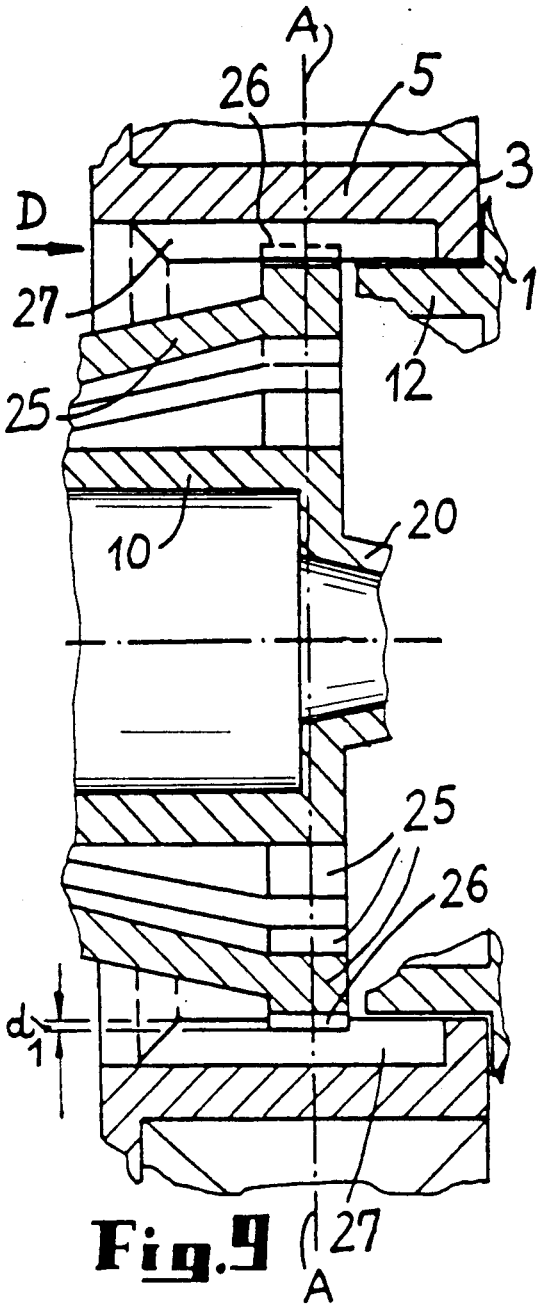

FIG. 9 a larger scale sectional detail along line IX—IX of FIG. 8.

Figure 10:
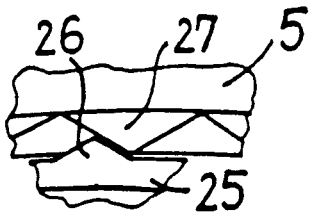

FIG. 10 a larger scale detail of the coupling tooth meshing in viewing direction D in FIG. 9.

FIG. 1 is a cross-section through a hand operated device for transferring a film from a carrier tape to a substrate, the sectional plane being constituted by that in which are located the two rotation axes of the two reels received in the device casing.

The casing has two casing sidewalls 1,2 converging downwards in V-shaped manner, linked at the top by a casing top 49, which in cross-section rises in roof-shaped manner from the two ends of the sidewalls 1,2 towards the centre, whilst also being linked at the bottom by a planar casing bottom 39, which gives a closed casing 36 (cf. also FIG. 3).

The casing contains a supply reel 3 and a take-up reel 4, whose median planes A—A and B—B are set in V-shaped manner with respect to one another by an angle $\alpha$, which precisely corresponds to the angle enclosed between them by the casing sidewalls 1 and 2.

Supply reel 3 has a reel core 5 and take-up reel 4 a reel core 6. To the reel core 5 is applied a tape supply 7 which, with increasing unwinding, builds up on the take-up reel 4 in the form of a growing tape supply 8. FIG. 1 shows the initial tape supply 7 on supply reel 3, i.e. the full tape supply 7 (maximum reel diameter), no tape supply having been wound here onto the take-up reel 4. The tape supply 8 indicated in dot-dash line manner on take-up reel 4 in FIG. 1 represents the conditions which occur when the entire tape supply 7 has been unwound from supply reel 3 and is completely wound onto take-up reel 4.

Core 6 of take-up reel 4 is carried at its axial end facing sidewall 2 by a carrier disk 9, whilst being open at its axial end facing the supply reel 3, so that within the core 6 of take up reel 4 there is an inner area 24 open towards the other reel.

The take-up reel 4 is provided in its middle area with a central, hollow stay bolt 10 projecting cylindrically in the direction of the other reel and its longitudinal extension is greater than the width of reel core 6, so that the stay bolt 10 projects out of the inner area of take-up reel 4 and into a similar inner area 23 formed within the core 5 of supply reel 3.

In its interior, stay bolt 10 has a bore or a cylindrical opening 48, which at the mouth of the stay bolt 10 is open into the carrier disk 9, so that there the take-up reel 4 with the stay bolt 10 can be mounted on a trunnion 11, correspondingly fitted to casing sidewall 2 and projecting into the interior of the casing.

At its other end projecting into the interior 23 of the pivot pin 5 of supply reel 3, the central stay bolt 10 is provided with a truncated cone-shaped, projecting central trunnion 20, which projects into and is supported in a bearing receptacle 21 formed on the other casing sidewall 1.

On casing sidewall 2 is also provided a collar 15 circularly concentric about the central axis of trunnion 11, at a distance therefrom and projecting slightly into the casing. On its inner ring face projecting over the casing sidewall 2, the collar forms an engagement of bearing surface for the carrier disk 9 of take-up reel 4, so that the latter cannot run against the casing sidewall 2. Collar 15, in conjunction with trunnion 11 and receptacle 21, ensures a good guidance and supporting of the central axis of the take-up reel 4 physically constituted by the central stay bolt 10, the reel 4 being supported on both the facing casing sidewalls 1 and 2.

As can also be gathered from FIG. 1 on the axially inner end of core 5 of supply reel 3 is provided a circular flanged coupling pulley 16 extending radially outwards from there and laterally supporting the tape supply 7 and to which is fitted a circular support projection 17, which in the represented construction has a trapezoidal cross-section, but with unequally long side legs.

The supply reel 3 inclined by angles $\alpha$ to the take-up reel 4 projects with its lower end (including the maximum tape supply 7 fitted to core 5) into the inner area 24 within the core 6 of take-up reel 4 and namely to such an extent that the support projection 17 engages in this area into a guide slot, where it is supported. The radially outer ring projection is in the form of a collar 18 and the radially inner ring projection in the form of a circular support sleeve 19. The inclination of their facing lateral flanks is selected in such a way that the support projection 17 can be positively supported on the flanged coupling pulley 16 of supply reel 3. There is simultaneously a support of the supply reel 3 axially with respect to the take-up reel 4 through the engagement of the inner face of pulley 16, which is radially inwardly connected directly to the support projection 17, on the correspondingly inclined end face of sleeve 19. On the casing sidewall 1 is provided a collar 14 projecting into the interior of the casing and which passes in concentric, circular, spaced manner about the rotation axis of the take-up reel and which permits an engagement of the radial end face of the supply reel 3 there, in such a way, as for the other reel, it is not possible for the supply reel 3 or tape supply 7 to run onto the casing sidewall 1. Obviously in the case of the shown axial guide faces acting in the different directions, the necessary guide clearances are provided, which are in part shown on a greatly increased scale in FIG. 1 to make understanding easier, but which are in fact only large enough to ensure a correct operation of the device.

In the case of the device shown in FIG. 1, the setting angle $\alpha$ is 12°, which ensures a favourable arrangement of the reels passing into one another. Whilst the supply reel 3 at its underside projects with the tape supply 7 carried by it to the greatest possible extent into the inner area 24 within core 6 of take-up reel 4, as shown in FIG. 1, at its upper end it is located completely outside the inner area 24, i.e. its complete width is alongside the take-up reel 4. This means that at this point the carrier tape 22 in the casing can be drawn rearwards from the supply reel 3, as can be gathered from FIG. 2.

The supply reel 3 is located on a trunnion 12, which is positioned on the casing sidewall 1 and projects into the interior of the casing. This trunnion 12 has a cross-sectionally sloping end face 13 inclined to the reel median plane A—A by an angle $\beta$, which is so chosen that an undisturbed entry of the central stay bolt 10 projecting from take-up reel 4 with its trunnion 20 fitted to the end is possible. This means that angle $\beta$ must be the same as angle $\alpha$.

Trunnion 12 is concentric to the bearing receptacle 21, but is radially outside the same. On it is supported the supply reel 3 on its axial end facing casing sidewall 1 by means of the carrier disk 50 supporting the reel core 5 and whose axial outer face engages on collar 14 of side-wall 1.

On its inner end face, which projects somewhat over the end face 13 of trunnion 12, the bearing receptacle 21 is inclined in the same direction as the latter and forms there a support against the radial face of the central stay bolt 10 radially outside the trunnion 20.

On the radial inside of core 5 of supply reel 3 is fitted an all-round inner tooth system 27, in which engage coupling teeth 26, which are fitted in outwardly radially projecting manner at the end of elastic coupling latches springing in radially with respect to the rotation axis of the take-up reel 4. These coupling latches 25 are arranged concentrically about the central stay bolt 10, sloping radially outwards from support disk 9 and spreadingly projecting towards the supply reel 3 and the length thereof, as shown in FIG. 1, is so selected that their axial faces are located in a plane with the radial face of the stay bolt 10, which the trunnion 20 projects. The complete arrangement is chosen in such a way that the coupling teeth 26 mesh along the entire rotation circumference with the inner tooth system 27 on core 5 of supply reel 3. Due to the reciprocal angular setting of reels 3,4, the engagement point of the coupling teeth 26 with the inner tooth system 27 moves axially along the latter and namely from the top, as shown in FIG. 1 engagement position furthest axially within the casing to the engagement position shown at the bottom in FIG. 1 axially furthest in the direction towards the casing sidewall 1.

The elastic coupling latches 25, the coupling teeth 26 and the inner tooth system 27 form an effective slip clutch in the rotation direction of the two reels 3 and 4 and which is shown in larger scale detail form in FIGS. 8, 9 and 10. FIG. 8 is a larger scale detail of FIG. 1, whilst FIG. 9 is a detail sectional view along line IX—IX of FIG. 8, i.e. a sectional plane parallel to the base plane displaced by 90° to the sectional plane of FIG. 8, in which the engagement between the coupling teeth 26 and the inner tooth system 27 takes place precisely symmetrical to the median plane A—A of supply reel 3.

The maximum lateral migration of the engagement point between the coupling teeth 26 and the inner tooth system 27, considered relative to the median plane A—A of the supply reel, on reaching the maximum inclination angle $\alpha$ (FIG. 8) is located between median plane A—A of supply reel 3 and median plane E—E of coupling teeth 26. The determinative quantity for such a coupling or clutch is the slide torque, in which the meshing tooth systems 26,27 skip. This slide torque is a function of the setting force of the resilient coupling latches 25, the frictional resistance (which is decisively determined by the material selection and the pressing conditions of the surfaces rubbing against one another), the tooth surface angles of tooth systems 26,27 and the travel $d_1$ (FIG. 9) or $d_2$ (FIG. 8). Among the aforementioned quantities, during a complete rotation, there is a particularly marked change to the insertion depth $d_1$ or $d_2$ or the corresponding lateral deflection travel. In order to always have an adequate insertion depth and in order to achieve complete effectiveness of the slip clutch, the tooth width L of the coupling teeth 26 (cf FIG. 8) is so dimensioned that the travel $d_2$ is equal to $d_1$ in the central engagement point according to FIG. 9 (i.e. parallel to the bottom surface of the casing), so that even in the least favourable case with maximum deflection (maximum lateral engagement displacement according to FIG. 8), the tooth depth $d_2$ is no smaller than the depth $d_1$ in the central engagement position not displaced with respect to the median plane A—A between the coupling teeth 26 and the inner tooth system 27.

As shown in FIG. 10, the surface inclination of the coupling teeth 26 on the coupling latches 25 or the inner tooth system 27 on the reel core 5 is so selected that only when the slide torque necessary for the desired tension occurs does the elastic springing in of the latches 25 take place to such an extent that the particular coupling tooth 26 is disengaged from the corresponding opposite tooth 27 of the inner tooth system and the desired skipping effect occurs.

The two reels are mounted in the following way, cf. FIG. 1. The rotary mounting of core 5 of supply reel 3 takes place on the supply reel side on trunnion 12 and on the drum side during tensile stressing through the removal of the carrier tape 22 on ring sleeve 19 of the take-up reel 4, which is also effective against axial displacement, whilst the collar 18 prevents tilting of the reel 3 into the interior 24 of reel 4 when the device is in the inoperative position. Further axial limitations are provided for the reel core 5 on casing sidewall 1 by collar 14 and for the take-up reel 4 on casing sidewall 2 by collar 15, which is located in an area where axial forces can occur, but twisting of drum 4 is avoided.

At the bottom in the cross-sectional view of FIG. 1 just above the base 39 and parallel thereto is shown in thick dot-dash line form the position of the application ledge C—C (corresponding to the position of the pressure edge 33 at the end of the application foot 31), in which the film coating of carrier tape 22 is transferred to a substrate. This plane is at right angles to the median plane through the angle bisector of the setting angle $\alpha$ formed by planes A—A and B—B (i.e. in the casing view of FIG. 1 at right angles to the vertical median plane of the overall casing) and also passes through the intersection edge S, which occurs at the intersection of planes A—A and B—B. FIG. 1 also shows with thin lines the inflow of the coated carrier tape 22 from the supply reel into the plane of the tape portion 35 (cf. FIG. 2) infront of the pressure edge 33 of the application ledge 22 and the return of the empty carrier tape 22 freed from the film coating towards the take-up reel 4 through corresponding thin section lines. It is pointed out that this representation only indicates the basic settings of the carrier tape 22, but not in the sectional plane which would occur in this form, cf. FIG. 1.

FIG. 2 shows the spatial association of the individual rotation parts and perspectively the configuration of the carrier tape 22. As shown therein from the tape supply 7 of the supply reel 3 at the top, i.e. where the entire width of the carrier tape 22 is completely outside the inner area 24 of take-up reel 4, the carrier tape 22 provided on its outside with a coating 28 (shown in hatched form) is drawn rearWards (relative to the casing) to a rotary guide pin 29, around the latter downwards to a further guide pin 30 and from the latter forwards to the pressure edge 33 of application ledge 32. In the area 35 of carrier tape 22 located between the last guide pin 30 upstream of application ledge 32 and the latter, the tape is rotated from the orientation which it has as a result of the setting of supply reel 3 by half the setting angle between reels 3 and 4, so that at the location of the pressure edge 33 it has the desired orientation shown in FIG. 1. As a function of the size of the supply reel, it has been found that e.g. for a supply reel with an external diameter of 40 mm and a tape width of 9 mm, a setting angle $\alpha$ between planes A—A and B—B of 12° is optimum with respect to the utilization of the advantages of the overall device. This means that here the torsion angle of tape portion 35 to both reel sides is 6°, which must be achieved in a particularly long portion 35 of tape 22, which is also particularly favourable, because here the twisting of the tape occurring per unit of length can be kept small. The application ledge 32 with the pressure edge 33 is constructed at the end of an elastically suspended pressure foot 31 and has, following the pressure edge 33, a leading or guiding edge 34 inclined with respect thereto and whose position on the application ledge 32 is such that, from the latter, the film application-freed, empty carrier tape 22, which is returned into the casing, runs off directly therefrom in correct orientation to the take-up reel 4. Such an association of the guiding edge 34 and pressure edge 33 can be achieved by the wedge-shaped construction of the pressure element 22 shown in FIG. 2. The raising of the tape end indicated at the end of the tape portion 22 running onto the take-up reel 4 does not infact represent a factual raising and instead in FIG. 2 merely illustrates the tape end running up onto the reel there.

As is also shown in FIG. 2 as a result of the setting angle between the two reels 3,4, it is possible for the supply reel 3 with its entire tape supply 7 to project downwards into the inner area 24 formed within the core of supply reel 4, as is apparent from the cross-section of FIG. 1.

FIGS. 4 to 7 show different possibilities for the construction of the application element 32 or for the arrangement of the pressure edge 33 and guiding edge 34.

Figure 4:
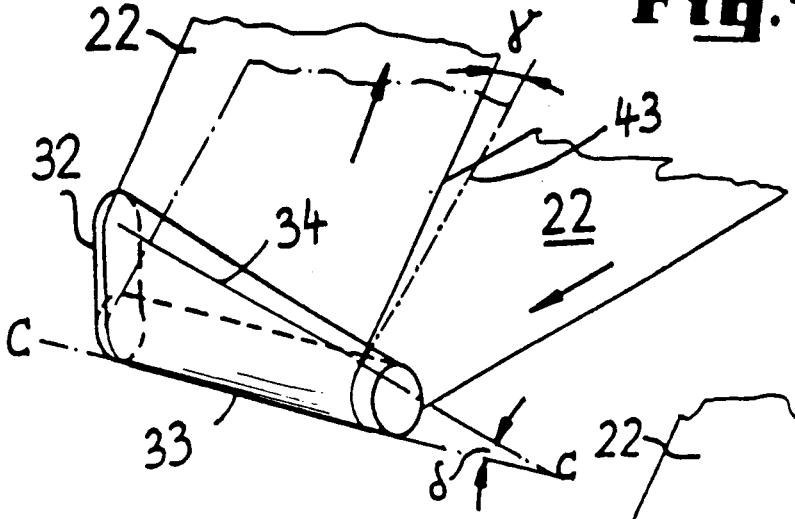

FIG. 4 illustrates in a much larger scale, the construction of the application ledge 32, as shown in FIG. 2 in the form of a horizontal, wedge-shaped part. The lateral deflection angle is $\gamma$ and occurs as a result of the inclined position of guiding edge 34 with respect to a tape configuration 43 (shown in dot-dash line manner), which would occur in the case of a purely cylindrical construction of the application element 32 (shown in broken line form). As is also shown in FIG. 4, the guiding edge 34 is set at an angle $\delta$ with respect to the pressure edge 33 and this leads to the desired lateral deflection $\gamma$.

Figure 5:
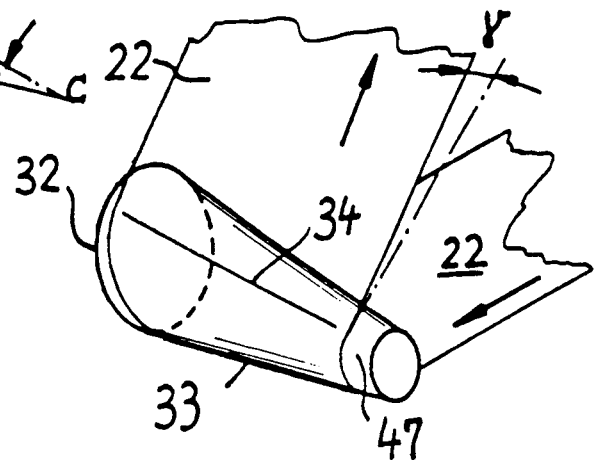

FIG. 5 shows an alternative embodiment for the construction of the application element 32, which is here truncated cone-shaped, which also leads to the desired lateral deflection $\gamma$.

Figure 6:
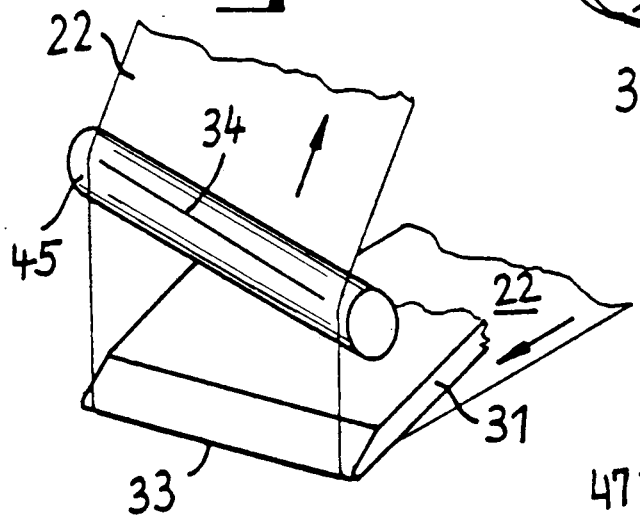
Figure 7:
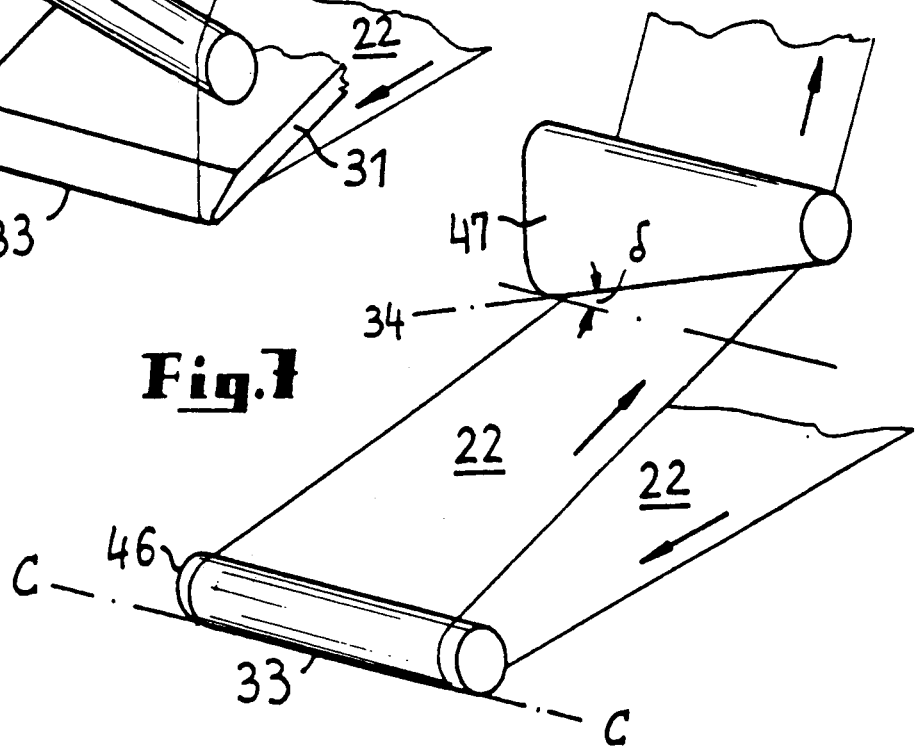

FIGS. 6 and 7 show two further solutions, in which the function of the application on the one hand and the deflection on the other are fulfilled by separate components or elements. Thus, in the case of FIG. 6, use is made of an elastic application foot 31, which in its front end region is bevelled towards a pressure edge 33. This application foot 31 can be elastically constructed and consequently it is possible to give the elastically shapeable application ledge desired for specific coating systems. The carrier tape 22 deflected on the pressure edge 33 and which behind said deflection point is freed from the film coating (because it is transferred to the substrate at the pressure edge 33), is passed onto a cylindrical guide pin 45 following in the tape path and which as a result of the corresponding spatial arrangement creates a guiding edge, i.e. discharge line 34 to the take-up reel 4.

In FIG. 7 the application ledge is formed by a cylindrical pressure ledge 46, on which the incoming carrier tape 22 is deflected and passed onto a following, separate, truncated cone-shaped or wedge-shaped guide element 47, which forms a guide edge 34 set by the desired angle which is here formed on the intake side, whilst on the discharge side, due to the following cylindrical rounding of part 47 said direction is also retained for the discharging tape.

In a simplified, very basic form, FIG. 3 shows the interfaces for the construction of a casing 36 for receiving the entire reel tape guidance and pressure means. The overall casing 36 is formed by the two casing sidewalls 1,2, which are set at an angle to one another, the casing top 49, which in cross-section rises slightly in roof-like manner from the upper end of the two sidewalls 1,2 to the centre of the casing, as well as a lower casing bottom 39. On its top surface the casing is provided with a bevelled front side 41 on which are arranged finger brakes 42 in the form of transverse ridges, which present the undesired sliding off of the pressing fingers of the user. In the casing sidewalls 1 and/or 2 are provided viewing holes 40 for establishing the degree of filling of the hand operated device.

The cross sections 37 and 38 shown in broken line form represent the cross-sections available in the casing for housing the overall arrangement, both as regards height and longitudinal extension. The hatched surface 38 simultaneously forms a plane for a linear, central tape supply from the last guide pin 30, whilst cross-section 37 shows the wedge-shape of the casing. The inclination of the front casing surface 41 is chosen in such a way that along line C—C it issues into the planar bottom surface 39, i.e. the pressing edge 33 of application element 32 (cf. FIG. 2) which is precisely located in line C—C, is ergonomically positioned in an optimum manner with regards to the overall shape of the casing 36, so that the pressure exerted by the user in the direction of the pressure edge 33 or line C—C is precisely in the alignment line of the sloping casing front half.

FIG. 3 also shows another possibility. Thus, in the form shown it would also be possible to construct a replacement cassette containing all the aforementioned components referred to in conjunction with such a construction as a casing and from which projects at the front, as from a casing, an application foot 31 with pressure ledge 32, etc. Such a replacement cassette could be inserted in a correspondingly constructed reception casing, which could be suitably opened and closed (e.g. by splitting the casing in the median longitudinal plane M) and which merely need be constructed in such a way that with the cassette 36 inserted the application foot 31 can project therefrom with the tape passing over it.

We claim:

1. Hand operated device for transferring film from a carrier tape to a substrate, in which in a casing the carrier tape is guided from a smaller supply reel to a pressure edge of an application foot projecting at the bottom of the casing in the outwards direction and from there back into the casing onto a larger take-up reel, the supply and take-up reel being coupled together by means of a slip clutch acting in the rotation direction, and with guide means for guiding the carrier tape fitted to the casing, characterized in that the supply reel (3) and take-up reel (4) are axially juxtaposed and are reciprocally inclined by an acute angle ($\alpha$), the supply reel (3) projecting at the bottom into the inner area (24) of the core (6) of the larger take-up reel (4) open on the side facing reel (3), whilst its top surface is located completely outside the same, that the slip clutch (25–27) is located centrally between the two reels (3,4), that the guide means in the tape guide of the carrier tape (22) are fitted between the supply reel (3) and the application foot (31) and that the pressure edge (33) is followed by a guiding edge (34) inclined at an angle ($\delta$) the lateral deflection of the carrier tape (22) towards the take-up reel (4).

2. Hand operated device according to claim 1, characterized in that the setting angle ($\alpha$) between the two reels (3,4) is 10° to 15°, particularly 12°.

3. Hand operated device according to claim 1 characterized in that the application foot (31) is so constructed and arranged that its pressure edge (33) is in a plane at right angles to the angle bisector of the setting angle ($\alpha$) between the two reels (3,4) and passes through the common section line (S) of the radial median planes (A,B) of both reels (3,4).

4. Hand operated device according to claim 1 characterized in that the slip clutch (25,26,27) is constructed with force closure effective within the core (5) of the smaller supply reel (3).

5. Hand operated device according to claim 1 characterized in that the take-up reel (4) is provided with a one-sided hollow, central stay bolt (10) projecting from the inner area (24) of its core (6) into the inner area (23) of the core (5) of the supply reel (3) and which is received by a trunnion (20) constructed on its projecting end in a bearing recess (21) on the associated casing sidewall (1) and on its other end is mounted with the inner bore (48) open there on a trunnion (11) on the other casing sidewall (2).

6. Hand operated device according to claim 5, characterized in that around the stay bolt(10) are provided a plurality of radially elastic, spring-in coupling fingers (25) spreadingly projecting towards the supply reel (3) and having on their ends radially outwardly projecting coupling teeth (26), which at least partly engage in a corresponding inner tooth system (27) fitted to the core (5) of supply reel (3).

7. Hand operated device according to claim 1 characterized in that on its side facing the take-up reel (4), the supply reel (3) is provided with a flanged coupling pulley (16), on whose outer face facing the take-up reel (4) is constructed a circular support projection (17), which in the lower, interengaging area of the two reels (3,4) is supported against a correspondingly constructed circular support member (18,19), arranged in the inner area (24) of core (6) of take-up reel (4) on the radial support disk (9) thereof.

8. Hand operated device according to claim 1 characterized in that at least two cylindrical guide pins (29,30) are provided as guide means.

9. Hand operated device according to claim 8, characterized in that the guide pins (29,30) are rotatable.

10. Hand operated device according to claim 1 characterized in that the guiding edge (34) is constructed directly on the application foot (31).

11. Hand operated device according to claim 10, characterized in that at the end of the application foot (31) is constructed an application ledge (32) in the form of an obtuse-angled truncated cone (47) located at right angles to the tape guide and for the purpose of constructing the pressure edge (33) and guiding edge (34).

12. Hand operated device according to claim 1 characterized in that the guiding edge (34) is fitted to its own component (45,47) following the application foot (31).

13. Hand operated device according to claim 12, characterized in that the guiding edge (34) is formed by a cylindrical guide pin (45).

14. Hand operated device according to claim 1 characterized in that the casing sidewall (1,2) adjacent to each reel (3,4) in each case runs parallel to the median plane (A—A,B—B) of the particular reel (3,4).

15. Hand operated device according to claim 8 characterized in that the centre axes of the guide pins (29,30) are parallel to the centre axis of the supply reel (3).

16. Hand operated device according to claim 1 characterized in that the supply reel (3), the take-up reel (4), the guide means (29,30) and the slip clutch (25,26,27) are contained in a replaceable cassette, which simultaneously carries the application foot (31) with application ledge (32) and pressure edge (33), as well as the guiding edge (34).

* * * * *